United States Patent [19]

Loggy

[11] Patent Number: 4,597,925

[45] Date of Patent: Jul. 1, 1986

[54] METHOD OF CONSTRUCTING A MODULAR REINFORCED BUILDING STRUCTURE

[76] Inventor: Albert D. Loggy, Portoviejo 442 Y Versalles, Quito, Ecuador

[21] Appl. No.: 752,033

[22] Filed: Jul. 5, 1985

[51] Int. Cl.[4] ..... E04B 1/16

[52] U.S. Cl. ..... 264/32; 52/741; 52/742; 264/34; 264/35

[58] Field of Search ..... 264/32, 35, 34; 405/229, 230; 249/26, 27; 52/741, 742

[56] References Cited

U.S. PATENT DOCUMENTS

| | | | |
|---|---|---|---|
| 2,365,145 | 12/1944 | Neff . | |
| 2,425,079 | 8/1947 | Billig . | |
| 2,616,149 | 11/1952 | Waller . | |
| 2,928,360 | 3/1960 | Heine, Jr. . | |
| 2,948,047 | 8/1960 | Peeler et al. | 264/35 X |
| 3,137,097 | 6/1964 | Zeinetz . | |
| 3,232,806 | 2/1966 | Widmer . | |
| 3,292,338 | 12/1966 | MacClarence et al. . | |
| 3,296,754 | 1/1967 | Silberkuhl et al. . | |
| 3,324,611 | 6/1967 | Gamber . | |
| 3,619,432 | 11/1971 | Harrington . | |
| 3,798,849 | 3/1974 | Biggs et al. . | |
| 4,036,921 | 7/1977 | Ellen | 264/32 |
| 4,047,357 | 9/1977 | Mulholland et al. . | |
| 4,077,177 | 3/1978 | Boothroyd et al. . | |
| 4,154,029 | 5/1979 | Kinkel et al. . | |
| 4,365,455 | 12/1982 | Braine . | |

*Primary Examiner*—Jan Silbaugh

*Attorney, Agent, or Firm*—LaValle D. Ptak

[57] ABSTRACT

A modular reinforced concrete building is in a generally elongated hexagonal shape, with a roof having peaks at both ends of the building and sloping downwardly toward the central portion of the building from such peaks to form a concave ridge. The building is constructed on temporary, removable frames by forming metal lath over a roof frame in the desired shape of the roof. Wall metal lath then is suspended from the roof and extends downwardly into a foundation ditch. Temporary sheeting is placed against the underside of the roof metal lath and the outside of the wall metal lath. Concrete then is poured into the foundation ditch, into which the wall metal lath extends, to anchor the lower edges of the walls in the foundation. Concrete is applied to the wall metal lath and, after that has hardened sufficiently, the roof is covered with concrete applied from above. After the concrete hardens, the temporary sheeting material and the supporting framework are removed.

12 Claims, 33 Drawing Figures

FIG. 1
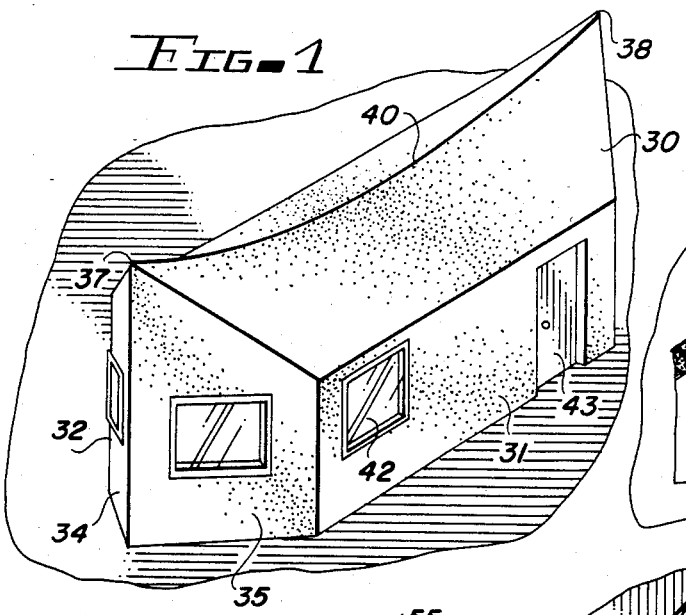
FIG. 2
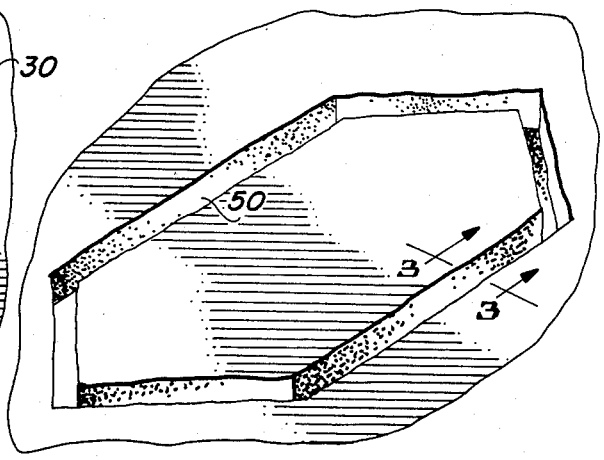
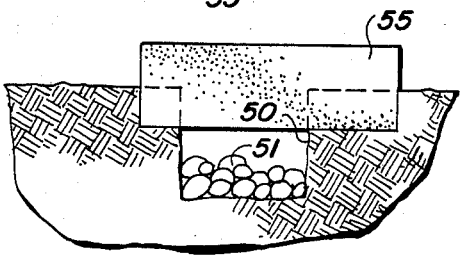
FIG. 3
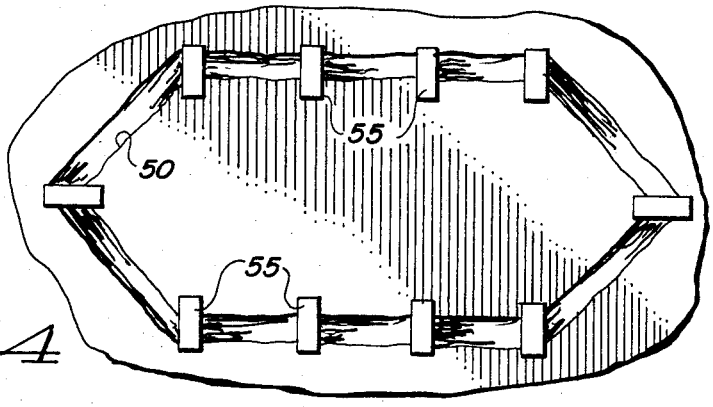
FIG. 4
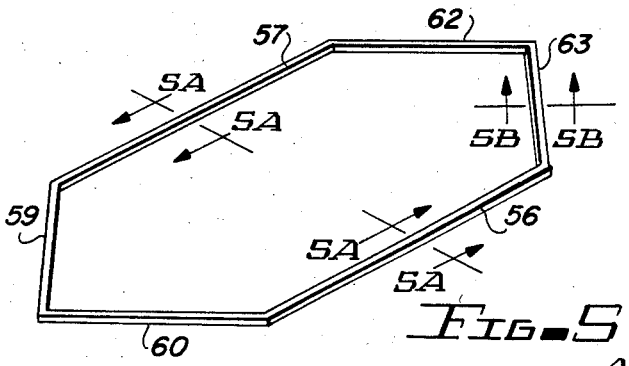
FIG. 5
FIG. 5A
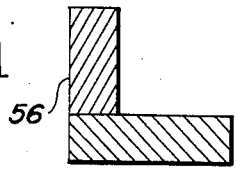
FIG. 5B
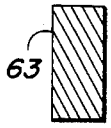
FIG. 6
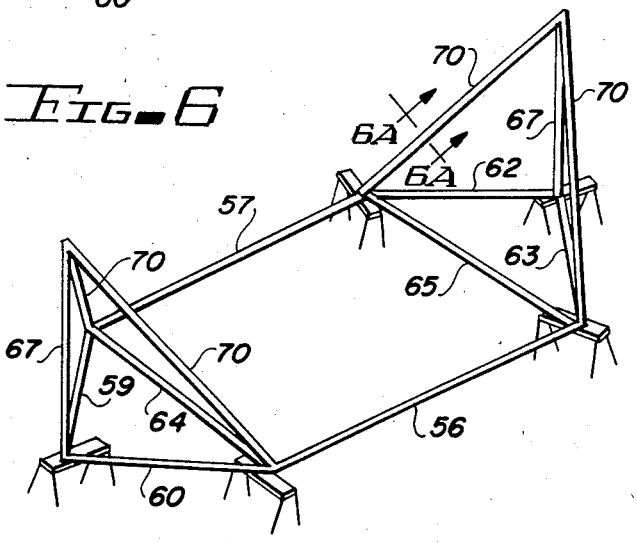
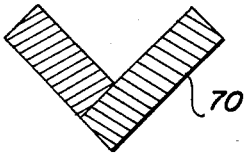
FIG. 6A FIG. 7
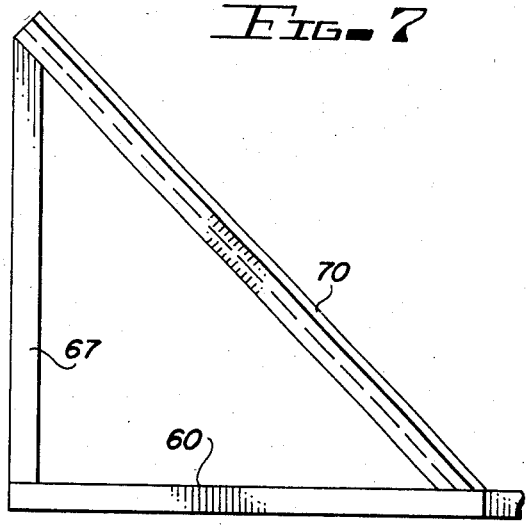
FIG. 8
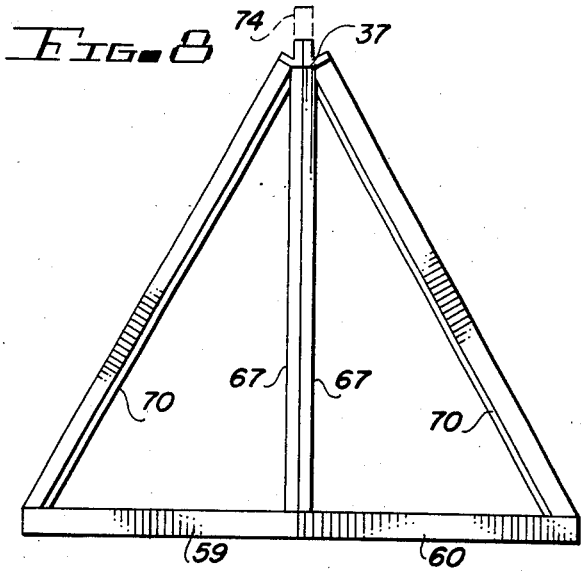
FIG. 9
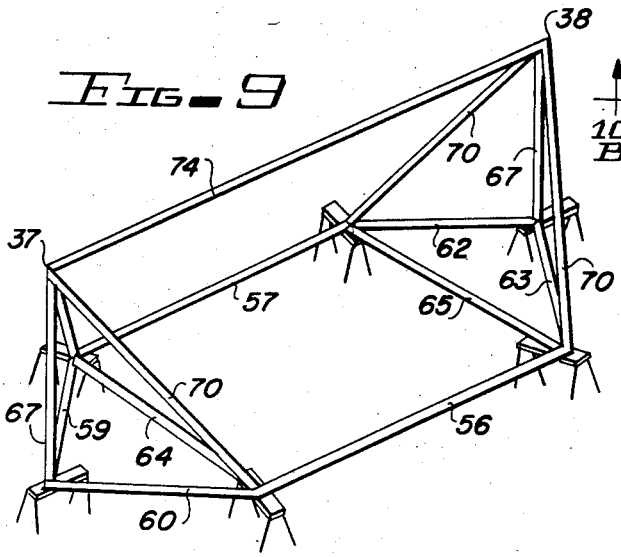
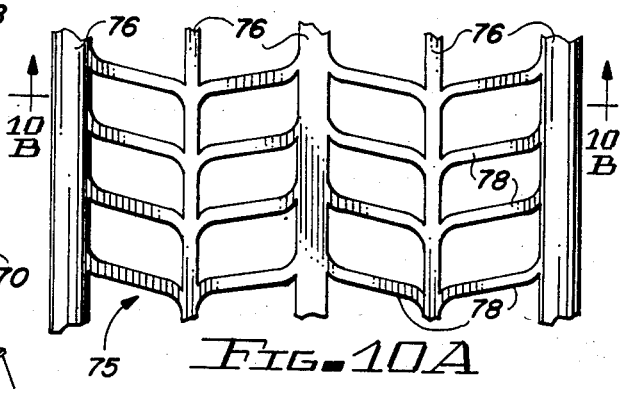
FIG. 10A
FIG. 10B
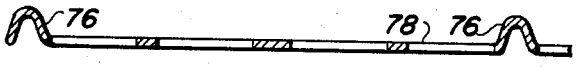
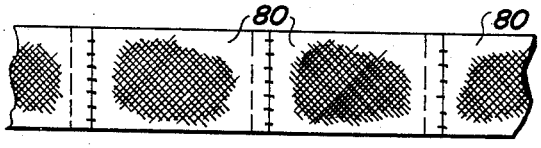
FIG. 11
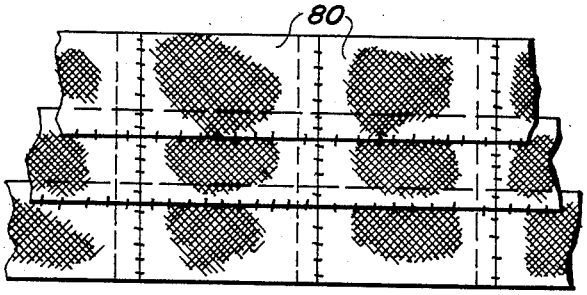
FIG. 13
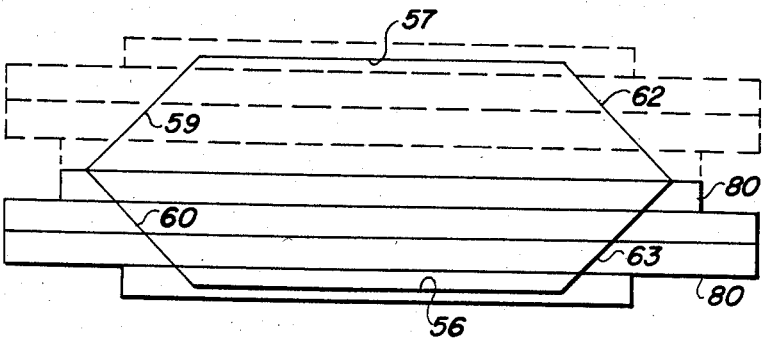
FIG. 12

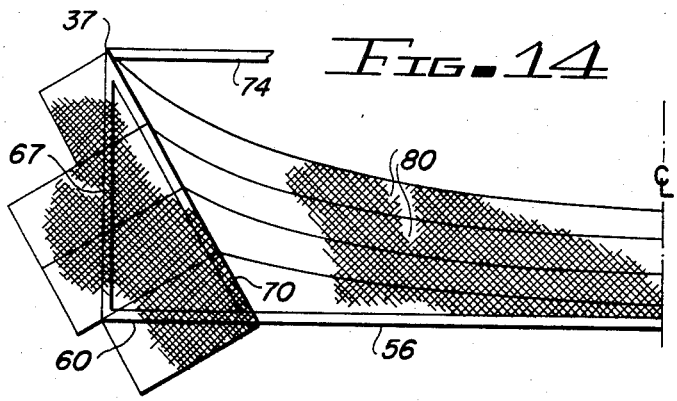
FIG. 14
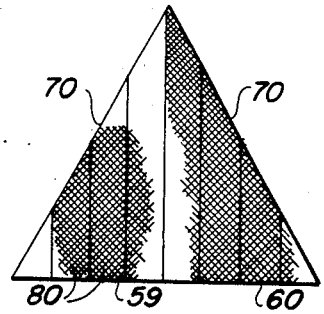
FIG. 17
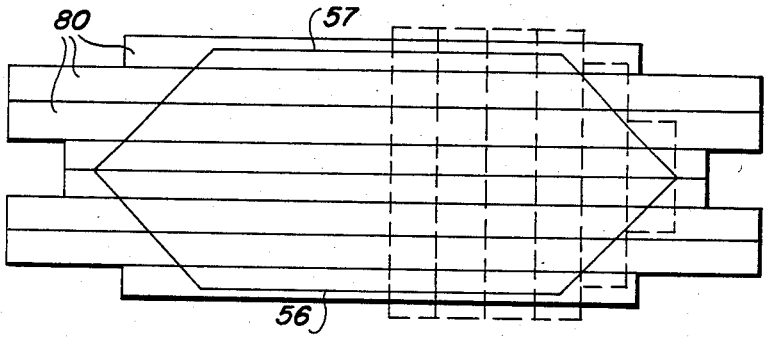
FIG. 15
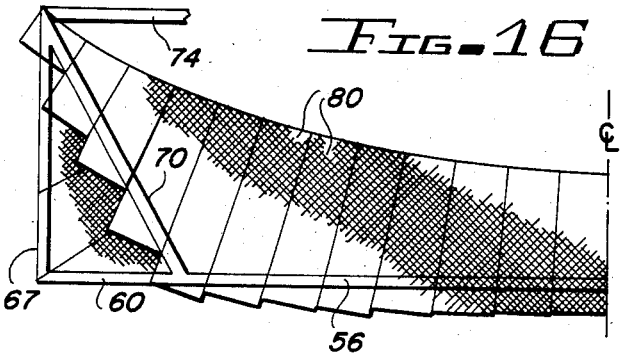
FIG. 16
FIG. 20
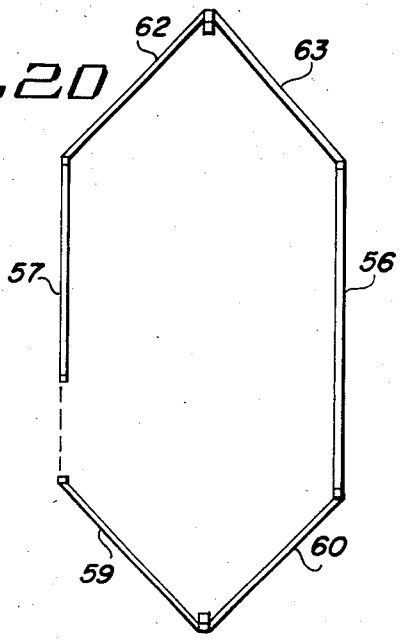
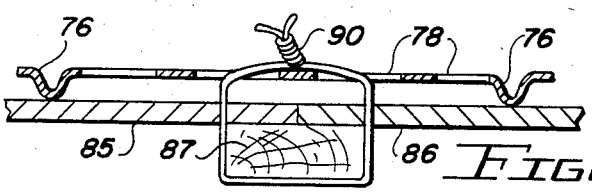
FIG. 18
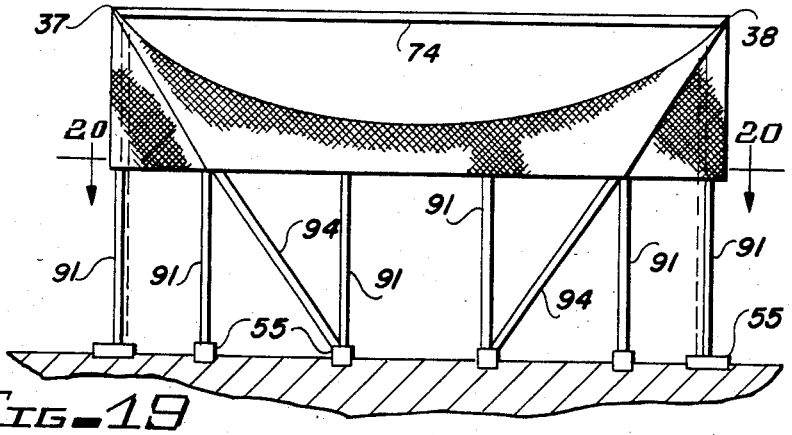
FIG. 19
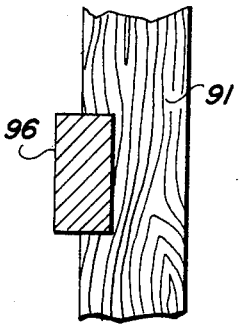
FIG. 22

FIG. 21
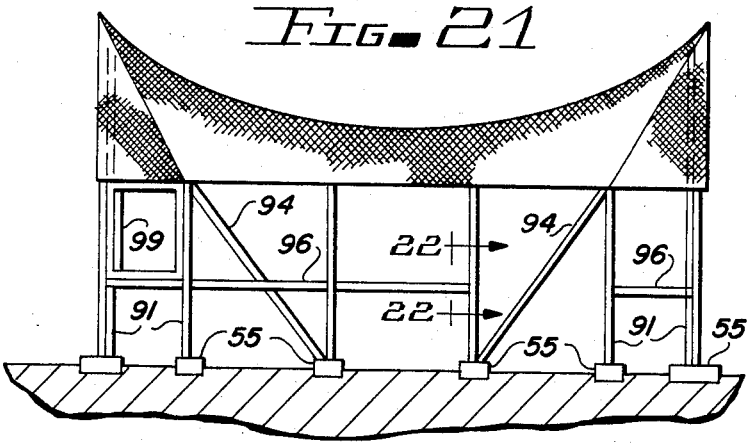
FIG. 23
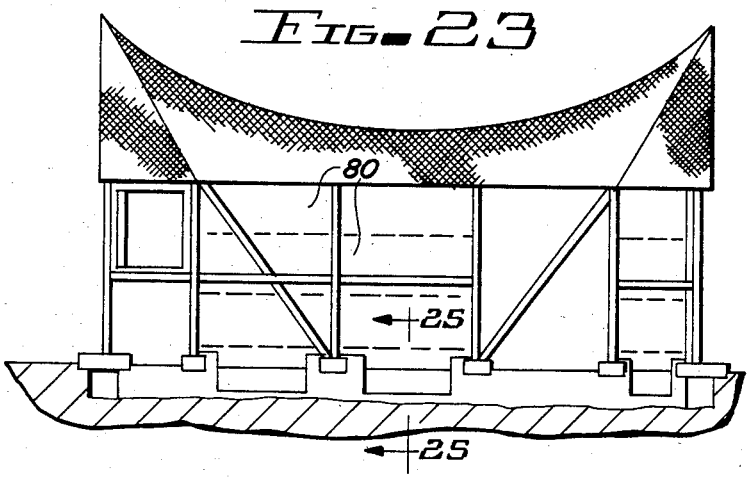
FIG. 24
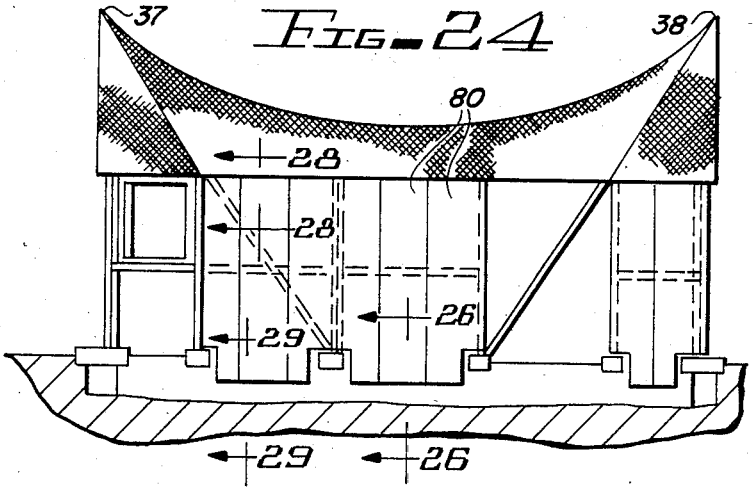
FIG. 28
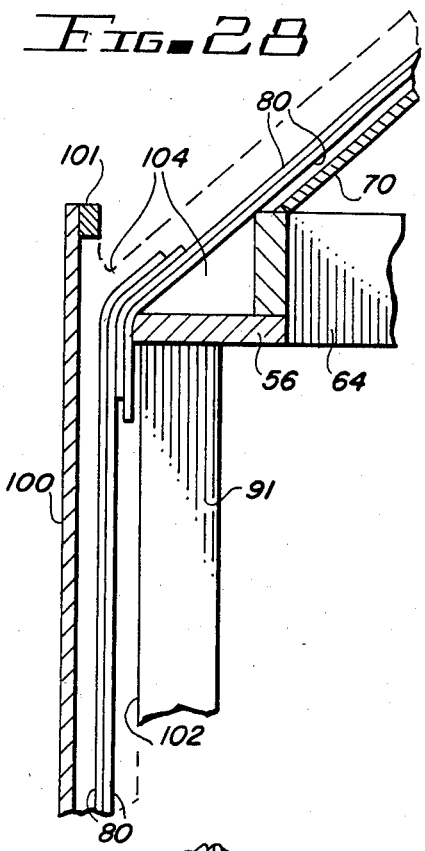
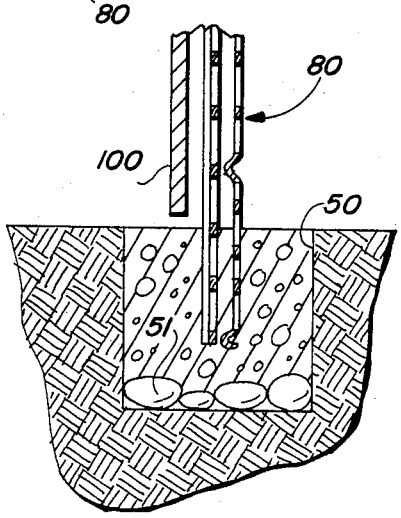
FIG. 29
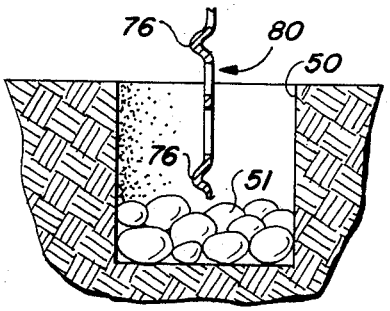
FIG. 25
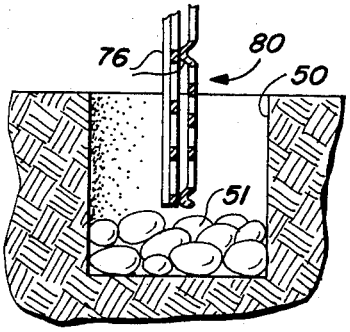
FIG. 26
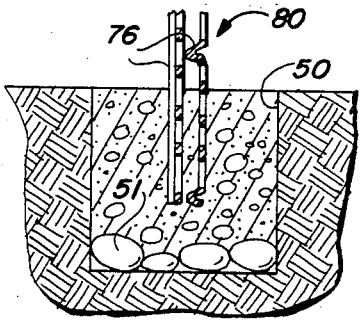
FIG. 27

METHOD OF CONSTRUCTING A MODULAR REINFORCED BUILDING STRUCTURE

BACKGROUND

Buildings made of reinforced concrete long have been constructed for both residential and commercial use. Typically, such buildings are made by using forms for retaining steel reinforcements and for shaping and defining the dimensions of the walls and other components of the buildings. The forms generally are made in modular sections in the form of sets of parallel surfaces or plates, and the concrete material is poured between the forms which remain in place until the concrete has set or become hardened. The forms then are removed and various combinations of forms are put together to form walls, roof panels and the like for another building. Generally, the form construction requires interlocking elements which are relatively expensive and cumbersome to use. In addition, skilled labor is necessary to insure that the forms are properly placed and supported to produce the desired building structure. Even so, this is the common approach which typically is taken in the construction of buildings having concrete walls, roof panels and the like.

In some concrete building construction, particularly large commercial installations, the floor and foundation of the building are formed first. Once the floor has set, forms are placed on the floor for the walls which then are poured in a horizontal position using the main floor of the building as a support base for the lower or back side of the wall form. After the wall panels which are poured into such horizontal forms have become set, the panels are raised up by means of heavy duty equipment to a vertical position around the periphery of the floor and to form internal walls. Such later-formed concrete walls must be attached to the floor or slab of the building by suitable means and the joints between the lower edges of these wall panels and the floor must be sealed to prevent water and air leakage. Although this type of construction is relatively widely used, it requires heavy duty on-site equipment to erect the walls and hold them in place while different wall panels are being attached to one another and to the floor of the building.

Efforts to provide simpler and less expensive reinforced concrete buildings which overcome the disadvantages of the two different construction methods described above have been made. Of particular interest is the U.S. Pat. to Gamber, No. 3,324,611. This patent is directed to the construction of a concrete reinforced building in which both the walls and roof are constructed of reinforced concrete. The outline or general framework of the building is first formed by steel rods which are assembled together in the overall shape of the building. These rods form the shape of both the sides and the roof. The horizontal rods, vertical rods and angled rods forming the roof all are interconnected where they contact one another by means of wire binding. Once the rod framework is in place, it is covered with inner and outer metal screens on both the walls and the roof. The screens are connected to the rod frame by twisted wire loops and the entire frame and screen combination (walls and roof) is sprayed with concrete through a nozzle such as a Gunnite type until the desired thickness of the wall and roof is maintained. The rods which form the shape of the building and the wire mesh all are bound together in the concrete to form a unitary structure. Thus, the original building frame becomes part of the integral structure of the completed building.

Another patent of the prior art utilizing reinforced concrete with an integral open metal frame is the U.S. Pat. to Neff, No. 2,365,145. This patent discloses a structural technique in which the walls and roof of a building are formed as a continuous arc. The building slab is poured first. An open metal frame then is put in place, generally in the form of a barrel or hemispherical-shaped outline extending from the slab to the peak of the roof of the building. This frame is covered by expanded metal lath and is finished with concrete. The walls and roof constitute a single unit and the supporting rods which give shape to lath remain in the finished structure. Thus, if a second building is to be constructed in accordance with the method of Neff, it is necessary to produce another set of forms or supports to create the shape of this subsequent building. This additional set of forms and supports then is consumed in or becomes a part of such second building when it is completed, and so on.

Two patents directed to the fabrication of reinforced concrete roofs having curved or compound-curved configurations are the U.S. patents to Heine, U.S. Pat. No. 2,928,360 and Widmer, U.S. Pat. No. 3,232,806. The Heine Patent discloses a system for fabricating a reinforced concrete roof having a compound-curved configuration. Wire cables, under stress, form the outline of the curved roof. A fine mesh is placed over this outlined structure. Plywood sheets or the like then are placed underneath the structure beneath the mesh before applying concrete to it. After the concrete sets, a temporary frame from which the cables are stressed and which is located about the periphery of the roof, is removed and the plywood sheets are removed. There is nothing in this patent which indicates the manner in which this roof is to be connected to any walls, if any. The illustrations are of free-formed roof members which touch the ground at spaced points and which typically may be used as covers for aircraft.

The structure of the Widmer Patent is one in which a wire mesh is suspended between temporary supports. The mesh is coated with a release material and netting is placed over the mesh. A binding material is placed on the netting and is allowed to harden. After the structure has set, that is after the binding material has hardened, the temporary supports and the underlying wire mesh are removed or stripped away. There is no mention in this patent of when the building walls are constructed in conjunction with the roof, but it appears that the roof is formed in place and that building walls of otherwise conventional configuration (that is block or frame) are constructed and attached to the roof in some way. The manner in which the underlying mesh which supports the roof is removed prior to or at the time of erection of the building walls is not disclosed in this patent. The patent does not disclose an integral formation of a roof/wall building structure.

It is desirable to provide a reinforced concrete building module which overcomes all of the disadvantages of the prior art mentioned above. It is further desirable to provide a reinforced concrete building structure and method which does not require heavy equipment, which employs reusable, removable forms of very simple configuration, and which employs materials which readily may be incorporated into the building structure by unskilled labor.

SUMMARY OF THE INVENTION

Accordingly, it is an object of this invention to provide an improved building structure.

It is another object of this invention to provide an improved reinforced concrete building structure.

It is an additional object of this invention to provide a simple and strong reinforced concrete building structure.

It is a further object of this invention to provide an improved method for building a building module.

It is yet another object of this invention to provide an improved method for constructing a reinforced concrete building structure, employing reusable forms and requiring a minimum amount of labor.

It is still a further object of this invention to provide a method for constructing a reinforced concrete building module in which the roof, walls and foundation are formed together as an integral unit in the completed structure.

In accordance with a preferred embodiment of this invention, a reinforced concrete building module includes a pair of spaced-apart, elongated vertical side walls. Each of these side walls are interconnected with a pair of end walls which extend outwardly from the area defined between the side walls to form a point at both ends of the building. The end walls extend upwardly to a point or peak where they join and the roof of the building forms a concave arch with the high points at both of the peaks at the opposite ends of the building. The roof and walls are formed by sheets of metal lath. Temporary flat sheets are placed on the outside of the walls and under the roof portions to form a backing against which concrete is pressed into the metal lath to form the structural rigidity of the building. The lath for the walls and the roof join together to form an integral structure of significant strength.

BRIEF DESCRIPTION OF THE DRAWINGS

FIG. 1 is a perspective view of a completed building module made in accordance with a preferred embodiment of this invention;

FIG. 2 is a perspective view of a foundation trench for the building module of FIG. 1;

FIG. 3 illustrates a cross-sectional detail of a portion of the foundation trench of FIG. 2 with an additional feature of the invention illustrated;

FIG. 4 is a top view of the foundation trench of FIG. 2, illustrating another step in the method of construction of the building of FIG. 1;

FIGS. 5, 5-A and 5-B illustrate details of a framework which is used in the construction of the building shown in FIG. 1;

FIGS. 6 and 6-A illustrate additional details of framework members used in conjunction with the one shown in FIG. 5 for the construction of the building of FIG. 1;

FIGS. 7 and 8 illustrate additional details of the framework shown in FIG. 6;

FIG. 9 illustrates another step in the formation of the framework shown in FIGS. 5 and 6;

FIGS. 10-A and 10-B are detailed plan and cross-sectional views, respectively, of a component used in the building structure;

FIGS. 11 through 17 illustrate additional steps used in the construction of the building as shown in FIG. 1, employing the components shown in detail in FIGS. 10-A and 10-B;

FIG. 18 is a cross-sectional enlarged view of an additional construction step;

FIGS. 19 through 22 illustrate further steps in the construction of the building of FIG. 1;

FIGS. 23 and 24 illustrate the manner of applying material of the type shown in FIG. 10 to the sides of the building; and FIGS. 25 through 29 are cross-sectional, detailed illustrations of final construction steps used to form the building of FIG. 1.

DETAILED DESCRIPTION

Reference now should be made to the drawings in which the same or similar reference numbers are used throughout the several figures to designate the same or similar components. In addition, it should be noted that where the term "concrete" is used in this description, the term is intended to include cementitious or matrix materials of any suitable type which, while soft, may be applied to a surface and which subsequently harden to a structurally rigid substance. Typically, materials of this type are referred to as "cement" or "concrete" or some forms of "stucco". Any material, however, which is capable of being applied in the manner described in the following description and then subsequently hardened to produce the structural rigidity desired is considered to be included within the meaning of this term.

FIG. 1 is a top perspective view of a building module in the form of a house which has been constructed in accordance with a preferred embodiment of this invention. The house of FIG. 1 is of reinforced concrete construction and includes a roof 30, front and back side walls 31 and 32, respectively, and ends each of which are in the form of a pair of outwardly extending end wall sections or panels 34 and 35 joined together at the center of the building end at an angle to form a boat-shaped or pointed end. These ends also are higher at the center than on the sides where they join with the front and back walls 31 and 32. The upper portion of each of the panels 34 and 35 extends in a straight line to form a triangular upper section terminating in a pair of peaks 37 and 38 which form the highest points of the roof 30. The roof 30 is extended between the peaks 37 and 38 and has a ridge 40 which curves downwardly from each of the peaks 37 and 38 to a low point at the center of the longitudinal dimension of the house to form a concave, curved or swaybacked ridge 40. The house also has typical windows 42 and 43 located on the front and back side walls and on the end walls of the structure. The house which is illustrated in FIG. 1 is constructed in a very unique manner, requiring a minimum amount of skilled labor and materials. Several aspects of the construction differ substantially from standard construction techniques, but the end result is a very strong integral structure suited for a wide variety of different applications.

Reference now should be made to the remaining figures which are used to illustrate the manner in which the house of FIG. 1 is constructed. FIG. 2 is a top perspective view of a plot of ground on which the house is to be located. The first step is to dig a foundation trench 50 in the shape of the outer periphery of the building module to be erected on the site. The trench 50 for the foundation is of a width and depth suitable for the size of the building and the type of soil on which the building is to be erected.

FIG. 3 is a cross-section taken along the line 3—3 of FIG. 2 of the foundation trench 50 showing the placement of gravel 51 or the like in the bottom of the trench 50. At spaced intervals, shown most clearly in FIG. 4, bricks, concrete blocks or wooden blocks 55 are partially buried and extend across the top of the foundation of trench 50. The blocks 55 extend a greater distance to the interior of the building defined by the foundation trench 50 than they do to the exterior. The depth at which the blocks 55 are buried is selected so that the upper surfaces of the blocks 55 will be level with the floor of the finished building. The particular type of material used depends upon the availability of the material. Concrete blocks are preferred but, since concrete blocks may not be available in all areas, other materials may be used.

Once the blocks 55 are in place and the foundation trench 50 has been completed and partially filled with gravel 51, construction of the building itself may commence. This construction first is begun by building a roof framework which is seated on saw horses or trestles located over the foundation trench 50. This framework is illustrated in FIG. 5 and constitutes front and back side members 56 and 57, each of which are in the form of an L-shaped angle formed of wood or steel (again, depending upon availability of materials and preference of the builder). The L-opening faces outward, as illustrated in FIG. 5-A. End members 59, 60, 62 and 63 and a pair of transverse supports 64 and 65 (FIG. 6) may be constructed of simple 2×4 lumber (or larger sizes for larger-sized building modules) or steel secured to the side members 56 and 57 in any suitable manner. This framework is supported on the saw horses or trestles, as shown most clearly in FIG. 6, a relatively short distance above the ground.

To the basic portion of the roof framework, which is illustrated in FIG. 5, the upright, triangular end sections to form the peaks 37 and 38 shown in FIG. 1 are added. These constitute four identical triangular frame members of the type shown in FIG. 7 with the bases of each of the triangles constituting the members 59, 60, 62 and 63, respectively. A vertical member 67 extends upwardly from each of the base members 59, 60, 62 and 63; and the triangle is completed by means of a V-shaped angle member 70, shown in cross-section in FIG. 6-A. FIG. 7 is a side view of the triangular roof frame member which constitutes the front left member of the completed frame structure shown in FIG. 6. FIG. 8 is an end view of the triangular end frame member as viewed from the left of the structure shown in FIG. 6 to illustrate the manner in which two of the adjacent triangular frame members are connected together to form the completed end frames. The manner in which the triangular frame members of FIGS. 7 and 8 are connected to the hexagonal base frame member of FIG. 5 is by any suitable means. Since these frame members are temporary and do not constitute any part of the finished structure, the manner in which they are connected together should be selected to permit them to be readily disassembled and reassembled for another building construction.

Prior to the next step of forming the roof on the temporary framework of FIG. 6, a temporary ridge pole 74 is connected between the peaks 37 and 38 to provide temporary rigidity to the structure and to prevent the peaks 37 and 38 from tipping inwardly. The triangular end frame structures, with the boat-shaped or pointed ends of the building, provide substantial rigidity to the framework to prevent this from happening, but the ridge pole 74 provides an added dimension of security during the construction of the roof to ensure integrity of this construction throughout all phases until it is completed.

FIGS. 10-A and 10-B illustrate details of an expanded metal lath in the form of perforated steel lamina, approximately 1 millimeter in thickness, which has longitudinal strips 76 spaced apart approximately every two centimeters and interconnected by connecting webs 78. Every fifth longitudinal strip is folded or indented as illustrated in FIG. 10-B to cause it to project as a "nerve" above the plane of the remainder of the expanded metal lath sheet. Thus, the folded or "nerved" strips 76 occur approximately every eight centimeters. This material is available in elongated, rectangular sheets 80.

In the construction of the roof of the building shown in FIG. 1, several of the metal lath sheets 80 are joined together end-to-end by overlapping them approximately 10 centimeters and tying them together with twisted wire knots of sufficient number to hold the sheets 80 together for subsequent handling. Thus, elongated strips of the sheets 80 are formed as shown in FIG. 11, and these sheets are placed over the framework illustrated in FIG. 9 in a pattern generally of the type illustrated in FIG. 12, which is a top view looking down on the frame illustrated in FIG. 9. The sheets 80, formed together in the elongated strips illustrated in FIGS. 11 and 12 are overlapped on their edges by approximately 5 centimeters as as shown in FIG. 13. The overlapped edges of the strips of sheets 80 are tied together by use of wire knots at approximately 50 centimeter intervals. The elongated strips 80 may be placed on the roof frame of FIG. 9, either one or two strips at a time. The projection or "nerved" sides of the sheets, illustrated in the cross section of FIG. 10-B, face downwardly over the roof framework in the sagging configuration shown in FIG. 14, until the entire roof framework is covered from end-to-end with the interconnected strips of metal lath sheets 80 as illustrated in FIGS. 12 and 14. The strip along the lower edge parallel to the side frame members 56 and 57 is permitted to overlap the edge by approximately 10 centimeters along the side of the hexagonal frame. As is readily apparent from an examination of FIGS. 12 and 14, the sheets 80 extend past the edges formed by the members 70 and are folded back down over the plane of the openings of the triangle support members on the ends.

Additional elongated strips of the sheets 80 then are placed across the roof in a transverse direction to the longitudinal sheet placement described above in conjunction with FIGS. 12 and 14. This placement of transverse sheets is illustrated in FIG. 15 in dotted lines and in FIG. 16 by solid lines. The formation of elongated strips of sheets 80 and the overlapping of the sheets 80 to form a continuous interconnected covering for these transverse sheets is the same as described above for the longitudinal sheets. The transverse sheets 80 are placed with the nerve or projection side of the strips 76 down, and there is an approximate 30 centimeter overlap along the edges defined by the frame members 56 and 57. This overlap is folded back under at the edges of planned wall openings.

The transverse and longitudinal strips of sheets 80 are connected together at intervals with wire knots to provide a structural rigidity to the roof. At the ends, the transverse strips of sheets 80 are bent down to be parallel to the plane defined by the triangular end frame openings. On the ends of the roof framework, vertical sheets of expanded metal lath, of the type shown in FIGS. 10-A and 10-B, are placed as shown in FIG. 17 against the ends of the roof framework members to sandwich the ends of the transverse roof mesh against the longitudinal roof mesh where it overlaps or is bent over the frame members 70 to hold everything together. These outer vertical sheets 80, as shown in FIG. 17, are tied in position with wire knots to the underlying mesh and to one another at approximately 30 centimeter intervals.

Next, sheets of ¼" plywood, which have been waterproofed or otherwise treated with a suitable releasing agent, are placed transversely in the central section of the roof and are fixed to the underside of the expanded metal lath for the roof with longitudinally placed battens 87 wired in place with suitable wire 90 at approximately 60 centimeter intervals. At the ends of the roof near the peaks, similar plywood sheets are placed longitudinally under the lower layer of metal lath and are secured in place by the same battens. A detail of such construction is illustrated in FIG. 18 which shows sections of a pair of adjacent longitudinally abutting plywood sheets 85 and 86 with a wooden batten or furring strip 87 overlapping the seam formed by the abutting sheets 85 and 86. A wire 90 is placed through holes drilled in the sheets 86 and extends around the batten 87 and up through the expanded metal lath where it is twisted together to hold the sheets against the projections or raised portions of the nerved expended metal lath 76, as illustrated in FIG. 18. Obviously, for those plywood sheets which extend transversely to the longitudinally placed battens 87, the battens are not parallel to the joints but extend across the joints.

Once the entire underside of the roof has been provided with the underlying sheets of plywood, the roof is raised to its desired height. In most cases, this is approximately 2 meters. It may be raised by a crane or, for small buildings, by lifting first one end and then the other manually.

Once the roof is raised to the position shown in FIG. 19, temporary vertical supports 91 are placed to extend upwardly from the blocks 55 (FIG. 4) inside the inner edge of the foundation trench 50 to engage the underside of the roof framework. These vertical supports are set into the interior of the building; and, in the completed construction they will be inside the inside surface of the walls to facilitate subsequent removal. Diagonal brace top of one vertical support to the foot of the adjacent supports 91 on each side.

Each of the vertical supports 91 has a notch or a groove formed on its inner side to receive a horizontal member 96 (FIGS. 21 and 22) to complete the temporary bracing of the building structure. The horizontal member 96 is located at a height selected to permit window frame members, such as the frame member 99 shown in FIG. 21, to be supported on it. Such window frame members next are put in place and temporarily attached to the horizontal member 96 and the vertical supports 91. All of the supports are plumbed and shimmed in place to cause the roof to be properly located over the foundation trench 50, with the outer edges of the roof framework extending over the center of the foundation trench 50.

The next step in the construction is to take additional strips of sheets 80 of the nerved open metal lath, connected together as shown in FIG. 11, and begin by joining such strips, with the nerve or ridges 76 out and with a 10 centimeter overlap, to the roof strips which are hanging down over the edge of the frame members 56 and 57 of the roof. These strips are interlocked together with knotted wire ties at approximately thirty centimeter intervals. The sheets are joined edge-to-edge, as illustrated in FIG. 23, to provide wire lath sides extending down into the foundation trench 50, as illustrated most clearly in FIG. 25. Openings are provided in the horizontal strips of metal lath for the window and door openings.

Following completion of the application of horizontal strips of lath sheets 80 to the sides, vertically oriented sheets of the nerved metal lath are placed over the horizontal sheets illustrated in FIG. 24. These vertical sheets are shown in FIGS. 24 and 26 and also extend downwardly from the edge of the roof into the foundation trench 50, as illustrated most clearly in FIG. 26. These vertically oriented sheets 80 have approximately a 15 centimeter overlap at the roof edge and the excess of the horizontal and transverse sheets forming the roof is sandwiched against the horizontal wall lath, and the wall is secured by knotting everything together with wire at approximately twenty or thirty centimeter intervals.

The building structure next is provided with braced sheets of waterproofed plywood, or plywood which has been treated with a suitable releasing agent, which are supported and braced against the outside vertical wall members of the building module. These sheets are connected together in sections and are suitably braced from the outside (not shown) to form a single-sided form 100 (see FIG. 28) on the outside of the layers of metal lath forming the side walls of the building. The upper edge of the sheets 100, along the frame members 56 and 57 has a longitudinal, horizontal board 101 attached to it for the purpose of forming an eave in the roof structure where it joins the walls. These plywood sheets 100 are leveled and plumbed to secure them against the outside of the structure. A partial set of sheet forms 100 may serve in place of a complete set if cement or mortar is applied to the walls a section at a time, rather than having forms for the entire building to permit application of cement or mortar to the wire lath of the walls in a single continuous operation. The structure which results, however, is the same in either case. The placement of these vertical plywood sheets 100 has not been illustrated since it may be done in any suitable manner.

The foundation or base trench then is poured, as illustrated in FIG. 27. Actually this step may be done either before the side walls form sheets 100 are put in place or after they are in place. In most cases, it probably is more convenient to pour this foundation prior to the placement of the side form sheets 100, although this is not necessary. As noted in FIG. 27, the lower ends of the expanded metal wire mesh for the walls are firmly anchored in the foundation by the pouring of concrete into the foundation trench.

The next step is to apply concrete to the walls from the inside against the form sheets 100. This concrete is built up to the desired level on the inside to completely cover the lath, causing the concrete to be firmly interspersed through and into the spaces in the metal lath hard against the sheets 100. In particular, the concrete should be forced into the corners and forced behind the temporary vertical supports 91. This concrete covering 102 for the interior walls is most clearly illustrated in FIG. 22.

The beam and gutter portion 104, which joins the walls to the roof, now is formed. This is shown most clearly in FIG. 28. At this stage of the construction, all of the framework and temporary supports are cleared of concrete to minimize, as much as possible, any roughness in the completed structure.

After approximately 12 hours or so, the temporary external form sheets 100 are removed; and the exterior walls may be finished with stucco or a plaster mortar mix as desired. Once all of the concrete for the walls and the beam 104 has hardened, the temporary ridge pole 74 for the roof support may be removed. The roof then is completed by applying concrete to it, pouring the concrete from above, commencing from the peaks 37 and 38 and progressing downwardly toward the central and lowest portion of the roof. The sheets 80 of the metal lath used in the roof should be vibrated during the application of the concrete to the roof to ensure full penetration through the metal lath to the underlying plywood forms.

After the roof has hardened, the wires 90 holding the battens 87 in place on the underside of the roof are cut to remove the plywood sheets and the battens. The underside of the roof is then plastered or otherwise finished to any suitable texture desired. All of the temporary frame members, including the framework illustrated in FIG. 6 and the supports 91, 94 and 96 of FIGS. 21 through 24, are removed for use in construction of a subsequent building module. The final step is to pour a concrete floor on the interior of the building level with the upper surface of the blocks 55, which extend into the interior.

It should be noted that the building module formed by the method which has been described above is a unique construction. First, all of the temporary supports which are used to provide the overall form of the building, are removed after the concrete is poured to permit them to be used subsequently. There are no internal structural supports of any type in the finished building, but an extremely strong structure results. The pointed or boat-shaped ends of the building serve to carry downward stresses from the roof and provide substantial structural integrity when combined wtih the various members which have been described. Different modules may be interconnected together to form interesting and varied structures. For example, a basic module may be used for each different room of a house or small office building. In addition, interior walls of more conventional type may be erected within modules of the type which have been described above. The buildings can be erected with unsophisticated equipment and with the use of unskilled labor, if necessary. The construction technique is simple but the resultant product is a very strong, reinforced-concrete structure suitable for a wide variety of applications.

Various changes and modifications will occur to those skilled in the art without departing from the true scope of the invention. Variations in the relative dimensions of the components used readily may be made by those skilled in the art. The particular dimensions of various components which have been discussed in conjunction with the foregoing description of the method of constructing the building, are to be considered as illustrative, since variations of these dimensions easily may be made without departing from the structure and the method of making it which has been described above. The foregoing description of a preferred embodiment of the invention is to be considered as illustrative only and not as limiting the true scope of the invention.

I claim:

1. A method of constructing a reinforced concrete building including the steps of:

placing metal lath over an open roof framework to form the desired shape of a roof while said framework is located near the ground;

temporarily positioning roof sheeting material on the underside of said lath to provide a form against which concrete subsequently may be placed over said lath;

preparing a foundation trench around the periphery of said roof framework;

raising said roof framework to a desired final height on temporary supports;

suspending metal lath from the outer edge of said metal lath of said roof to extend downwardly into said foundation trench;

placing temporary wall sheeting material about the outside periphery of said suspended metal lath between the ground and the point where said suspended lath is affixed to said metal lath of said roof;

pouring concrete into said foundation trench;

applying concrete to said suspended lath against said temporary wall sheeting material; and applying concrete to said metal lath of said roof against said roof sheeting material; and removing said wall and roof sheeting material, said temporary supports and said roof open framework.

2. The method according to claim 1 wherein said metal lath of said roof and said suspended metal lath comprise multiple layers of metal lath.

3. The method according to claim 1 wherein said temporary supports and said roof framework are located inside said building structure, and said wall sheeting material is located outside said building structure prior to the time concrete is applied, with concrete being applied to the suspended metal lath from the inside of said building and to the metal lath of said roof from the outside of said building.

4. The method according to claim 1 wherein the step of applying concrete to said metal lath of the roof of said building is delayed until the concrete applied to said foundation and said suspended metal lath has attained structural rigidity.

5. The method according to claim 1 wherein the roof frame initially is made in the form of an elongated hexagonal shape, having first and second spaced-apart parallel members defining the major portion of the length of the finished building with said members joined together at the ends thereof by upwardly extending triangular frame members to produce boat-shaped ends on the finished building; and wherein said metal lath of said roof is suspended from peaks at the mid-point of each of the ends concavely downwardly to a low point substantially midway between such peaks to form a concave external roof configuration.

6. The method according to claim 1 further including the step of removing said roof framework, said temporary supports, said roof sheeting material and said wall sheeting material after said concrete has hardened.

7. The method according to claim 6 further including the step of finishing the interior walls and the ceiling of the building after removal of said sheeting material, said roof framework and the temporary supports.

8. The method according to claim 1 further including the step of inserting window frame members and door frame members in place on the wall locations of said building after said roof framework has been raised to the desired height and is supported on said temporary supports; and wherein the step of suspending said metal lath from said metal lath of the roof includes leaving openings in such suspended metal lath at the location of said window frame members and said door frame members.

9. The method according to claim 8 wherein the roof frame initially is made in the form of an elongated hexagonal shape, having first and second spaced-apart parallel members defining the major portion of the length of the finished building with said members joined together at the ends thereof by upwardly extending triangular frame members to produce boat-shaped ends on the finished building; and wherein said metal lath of said roof is suspended from peaks at the mid-point of each of the ends concavely downwardly to a low point substantially midway between such peaks to form a concave external roof configuration.

10. The method according to claim 1 wherein said metal lath of said roof and said suspended metal lath comprise multiple layers of metal lath.

11. The method according to claim 10 wherein said temporary supports and said roof framework are located inside said building structure, and said wall sheeting material is located outside said building structure prior to the time concrete is applied, with concrete being applied to the suspended metal lath from the inside of said building and to the metal lath of said roof from the outside of said building.

12. The method according to claim 11 wherein the step of applying concrete to said metal lath of the roof of said building is delayed until the concrete applied to said foundation and said suspended metal lath has attained structural rigidity.

* * * * *